US005500990A

United States Patent [19]

Wihan

[11] Patent Number: 5,500,990

[45] Date of Patent: Mar. 26, 1996

[54] RIVETING TOOL

[76] Inventor: Josef Wihan, 549 32, Velké Poříčí 451, Czechoslovakia

[21] Appl. No.: 258,580

[22] Filed: Jun. 10, 1994

[30] Foreign Application Priority Data

Jun. 11, 1993 [CS] Czechoslovakia ..... 1141-93

[51] Int. Cl.[6] ..... B21J 15/10

[52] U.S. Cl. ..... 29/243.525; 29/243.53

[58] Field of Search ..... 227/112, 3, 4, 227/5, 6, 7, 8; 29/243.521, 243.523, 243.524, 243.525, 243.53; 72/391.4, 391.6, 453.17; 251/320, 321, 322, 323, 324, 325, 243

[56] References Cited

U.S. PATENT DOCUMENTS

| | | | |
|---|---|---|---|
| 4,517,820 | 5/1985 | Oefinger et al. | 29/243.525 |
| 4,598,571 | 7/1986 | Oefinger | 29/243.525 |
| 4,648,258 | 3/1987 | Frearson | 29/243.525 |
| 4,866,972 | 9/1989 | Schwab | 29/243.523 |
| 5,086,551 | 2/1992 | Shamaly et al. | 29/243.523 |

OTHER PUBLICATIONS

Description of BZ 80 (riveting tongs) from catalog of Honsel Co.—Germany, pub. date unknown.

Description of BZ 70 (riveting tongs) from catalog of Honsel Co.—Germany, pub. date unknown.

*Primary Examiner*—Richard K. Seidel
*Assistant Examiner*—Jay A. Stelacone
*Attorney, Agent, or Firm*—Burns, Doane, Swecker & Mathis

[57] ABSTRACT

A riveting tool includes a tool body having a hydraulic controlled rivet shank clamping assembly and a rivet suction system. A control valve is provided for directing a flow of pressurized air to the rivet clamping assembly and the rivet suction system. The control valve includes a valve rod having a valve rod piston on an upper end and a plurality of radial steps arranged on an outer surface of a lower end. A trigger is mounted slidably in a trigger transverse guide in the tool body and a spring is located within the trigger transverse guide such that pressure applied to the trigger causes the valve rod to move within the control valve from a first to a second position. When the valve rod is in the first position, pressurized air is guided to the rivet suction system. When the valve rod is in the second position, pressurized air is guided to a space below a pneumatic piston. A space above the pneumatic piston is connected to the hydraulic cylinder of the hydraulic controlled rivet shank clamping assembly.

11 Claims, 6 Drawing Sheets

RIVETING TOOL

FIELD OF THE INVENTION

The invention relates to a hydraulic-pneumatic riveting tool arrangement with a rivet suction system and rivet shank remainder exhaustion after riveting.

DESCRIPTION OF THE PRIOR ART

Known hydraulic-pneumatic riveting tools consist of a lower pneumatic part which is connected with an upper hydraulic controlled clamping system for blind rivet shanks, wherein said clamping system is provided with collets. A tool body made of plastic and shaped into a handle is provided with metallic press-in liners for guiding a hydraulic and pneumatic piston. In the lower pneumatic part of the tool an air valve is disposed and is usually controlled by a vertical valve rod. In said lower part there are arranged also channels for pressure air passage, serving for air supply from a source to a control valve, for connecting said valve with a space below the pneumatic piston and for air outlet. Pressure air stream starting is carried out by compression of a coiled spring and by rollers compressing a bored valve rod, being provided with an inner spring, which bears on a supporting ball on its side adjacent to a trigger. Said valve rod is provided with steps for sealing O-rings.

Said known riveting tools are of a relatively complicated structure and are relatively heavy which is a highly disadvantageous feature especially when said tools are hand operated. Apart from other disadvantages, known riveting tools are complicated including the hydraulic piston arrangement and the rear screw joint positioned behind the piston which consists of a great number of elements (e.g. of doubled spring seatings on the piston and a front nozzle consisting of two mutually screwed parts etc.) which increase the production costs and the weight of the tool. The known system for rivet suctioning comprises a complicated metallic press in liner with bored channels. The structure of the valve rod and the triggering system is complicated as well.

SUMMARY OF THE INVENTION

Said disadvantages are eliminated to a certain extent by the riveting tool arrangement according to said invention, consisting of a body being connected on one end thereof with a pneumatic lower part and carrying an upper part with a hydraulic controlled rivet shank clamping assembly on the other end thereof. The clamping assembly is provided with a chuck collet and a hydraulic cylinder of said assembly is connected with a space above the pneumatic piston upper part, being formed in the tool body.

A pressure air outlet of a control valve is opened below the lower part of the pneumatic piston which is guided in a cylindrical recess in the lower part of the tool. The control valve is fastened in the massive partition wall of the tool lower part and is connected through a valve rod, guided freely in the longitudinal cavity of the body, with a trigger being disposed slidably in a linking up transversal guide formed also in the tool body.

The subject-matter of said invention includes a sealed piston body situated on the valve rod and an upper stepped end of the piston body which bears on a convex leaf spring the upper arm of which is supported on an upper wall of the trigger transversal guide and the lower arm of which is supported simultaneously against a radial surface of a shoulder of the piston body. The trigger sits tightly on said radial surface. An opposite lower end of the valve rod, having an outer diameter smaller then the diameter of the guiding bore in the massive partition wall in the tool lower part, reaches freely by axial shoulder of the same into an inner cavity of the valve body. The valve body is seated slidably in a sleeve arranged in the massive partition wall of the lower part. A system of radial steps is arranged on an outer surface of said lower end of the valve rod and number of sealing elements defining functional passage of the pressure air in deposited in said sealing elements. The valve rod has a through-hole along the whole length thereof which is opened on a lower end into the inner cavity of the valve body which is connected with a pressure air source and an upper end of the valve rod is opened to a system for rivet suction. The structure of the tool is thus simplified and the weight of said tool is decreased.

Three channels for passing the pressurized air are arranged one above the other and are opened into the guiding bore of the valve rod in the massive partition wall of the tool lower part and three sealing rings of the control valve are arranged in radial steps formed along the height of the valve rod. In a closed position of said valve, the valve rod bears by its lower step on a face seat surface of the valve body below a mouth of the supply channel and simultaneously the upper sealing O-ring and the central sealing O-ring close annular space between the valve rod and guiding bore wall in the massive partition wall above the connecting channel, being opened into a space below the pneumatic piston, and near the upper surface of the massive partition wall.

In the opened position of the control valve the third, lower sealing O-ring closes said annular space between the supply channel and the connecting channel and the central sealing O-ring closes a space between the connecting channel and the outlet channel. The opened upper part of the guiding bore is connected in said opened position of the control valve with a space below the pneumatic piston and the lower part of the guiding bore is connected with the inner cavity of the valve body.

A sealing element may be mounted in a radial groove formed in the inner cavity of the valve body. A regulating roller is clamped on the valve body located in the inner cavity of the sleeve which is fastened to the lower surface of the massive partition wall, and a wall of said regulating roller overhanging a part of the sleeve section is provided with an L-shaped groove for a free end of a take up pin guiding, said pin is fastened in the sleeve. An outer lower surface of the regulating roller in its shifted in position fits with the lower edge of the tool lower part. Said lower edge may be formed by a lower peripheral surface of a plastic ring which is firmly slipped on the tool lower part. Said regulating roller is automatically shifted in when said riveting tool is put onto a plane surface and, at the same time, is effective for closing the regulating air valve of the tool.

A cylindrical body of the oil gauge is anchored in the massive partition wall of the tool lower part and a sealed piston passes through said cylindrical body. A compression spring is arranged between a shoulder of the sealed piston and a bottom of the cylindrical body and above said shoulder there is disposed a safety element, wherein one end of the piston fits on a lower surface of the pneumatic piston and the other indicating end passes through a hole in the bottom of the cylindrical body. The cylindrical body is anchored in the massive partition wall by a double step system and a sealing element is disposed on contact walls between the two steps. When oil shortage in a hydraulic system of the tool occurs, said state is indicated visually by shifting in the oil gauge piston.

A safety pin is fastened to the body and is disposed in a transversal guide of the trigger in a space between a convex leaf spring and the piston body. Said safety pin prevents said convex leaf spring from falling out or shifting out from an operating position and thus secures the correct trigger function. Said convex leaf spring may be formed by a U-shaped steel strip, whose arms are provided with opened recesses through which passes said piston body. The leaf spring arms bear on a bottom of the transversal guide for the trigger.

BRIEF DESCRIPTION OF THE DRAWINGS

Further features of the present invention will become apparent to those skilled in the art to which the invention relates from reading the following specification with reference to the accompanying drawings, in which.

DESCRIPTION OF SPECIFIC PREFERRED EMBODIMENTS

Figure 1:
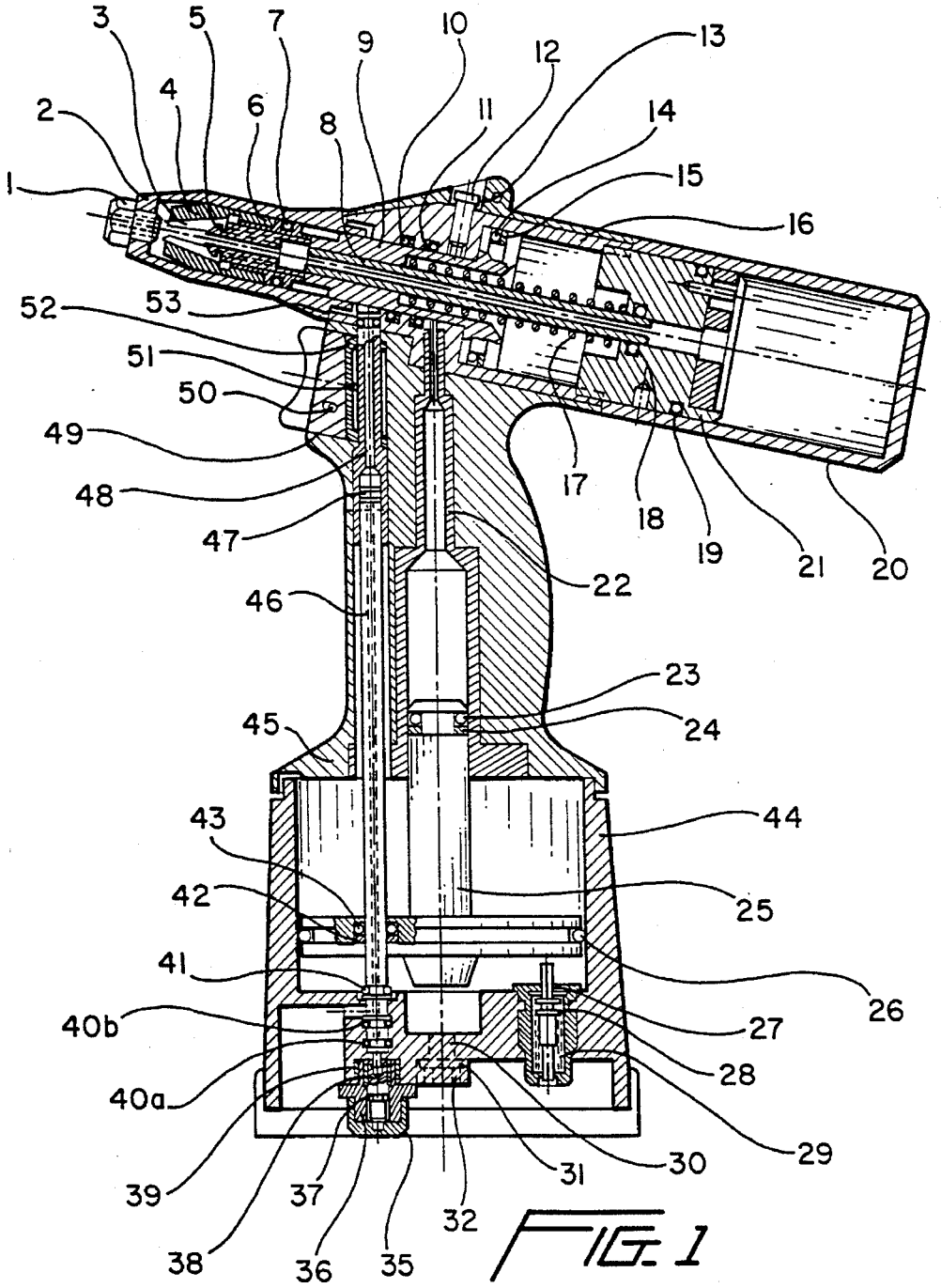
FIG. 1 is a cross sectional view of the hydraulic-pneumatic riveting tool total assembly.

A riveting tool consists of two fundamental parts, of a body 45 and of a cylindrical pneumatic lower part 44 which are mutually connected by two connecting bolts 30. A metallic (aluminium) press-in liner 16 of a hydraulic piston 9 is embedded in a plastic body 45 having a handle shape and a metallic (aluminium) press-in liner 22 of a pneumatic piston 25 is compressed with said metallic press-in liner 16. Said metallic press-in liners 16, 22 serve for guiding said steel hydraulic piston 9 and for guiding said plastic pneumatic piston 25. The pneumatic piston 25 reaches by upper sealed part thereof (a sealing O-ring 23 and a plastic ring 24 of the pneumatic piston 25 are mounted in a shoulder of said upper part) into the body 45 of the tool and by a lower enlarged sealed part thereof (being sealed with an O-ring 26 of the lower part of the pneumatic piston 25) into a plastic lower part 44 of the tool.

Figure 2:
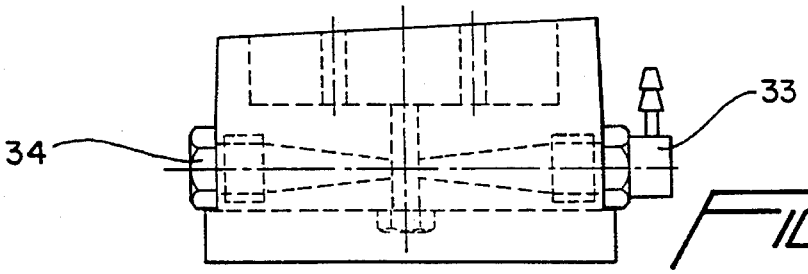
FIG. 2 is a schematic view of a lower part of the tool in a position being turned in angle 90° to view direction in FIG. 1, where dashed lines denote air channels.
Figure 3:
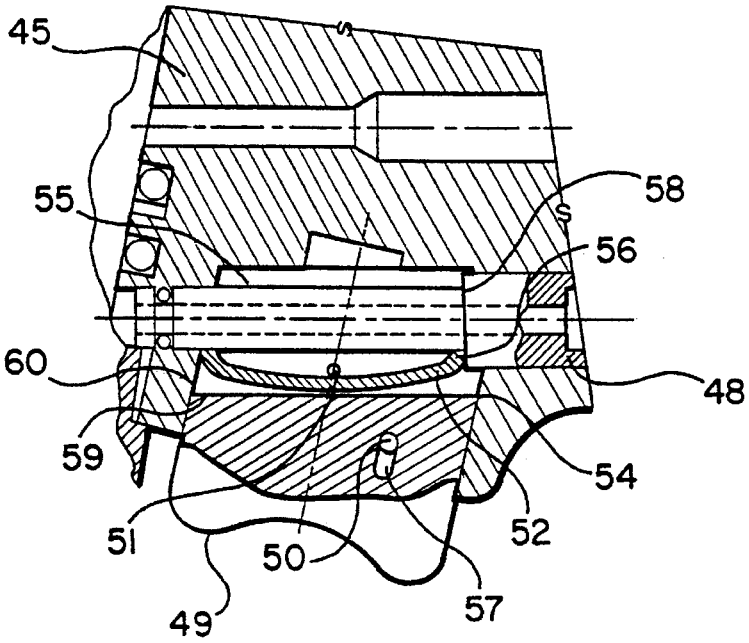
FIG. 3 is a cross sectional view of a tool part with a trigger in released state.
Figure 4:
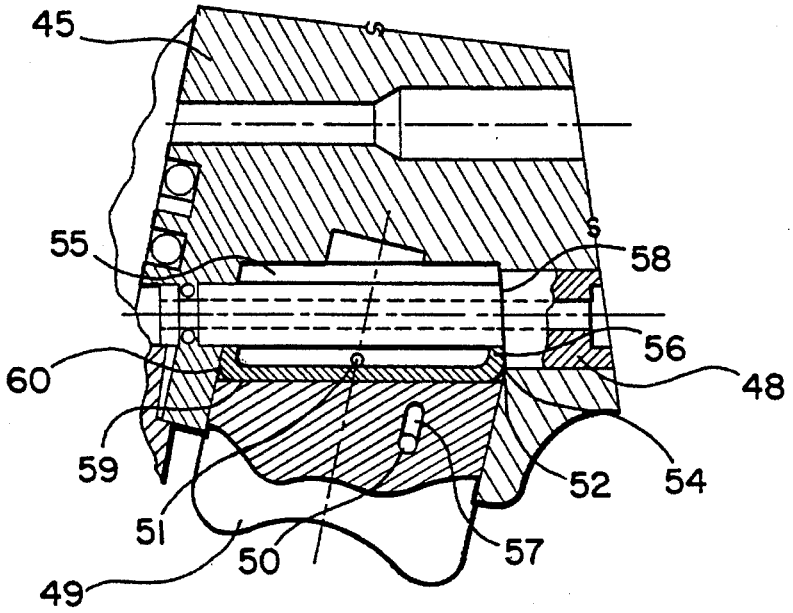
FIG. 4 is a cross sectional view of a tool part with a trigger in depressed state.

Said tool lower part 44 is provided with an inner cylindrical recess forming a working surface of the pneumatic piston 25. Said recess is terminated on a lower part thereof with a wall of a massive lower partition in the whole diameter of the lower part 44. In the massive partition wall there are arranged air passing through channels (depicted by dashed lines on FIG. 2) which are opened on the outer periphery of the lower part 44 into an angled supply valve 33 on the one hand, and to a safety valve 34 adjusted to maximum allowed air pressure (7 bar) on the other hand.

Figure 5A:
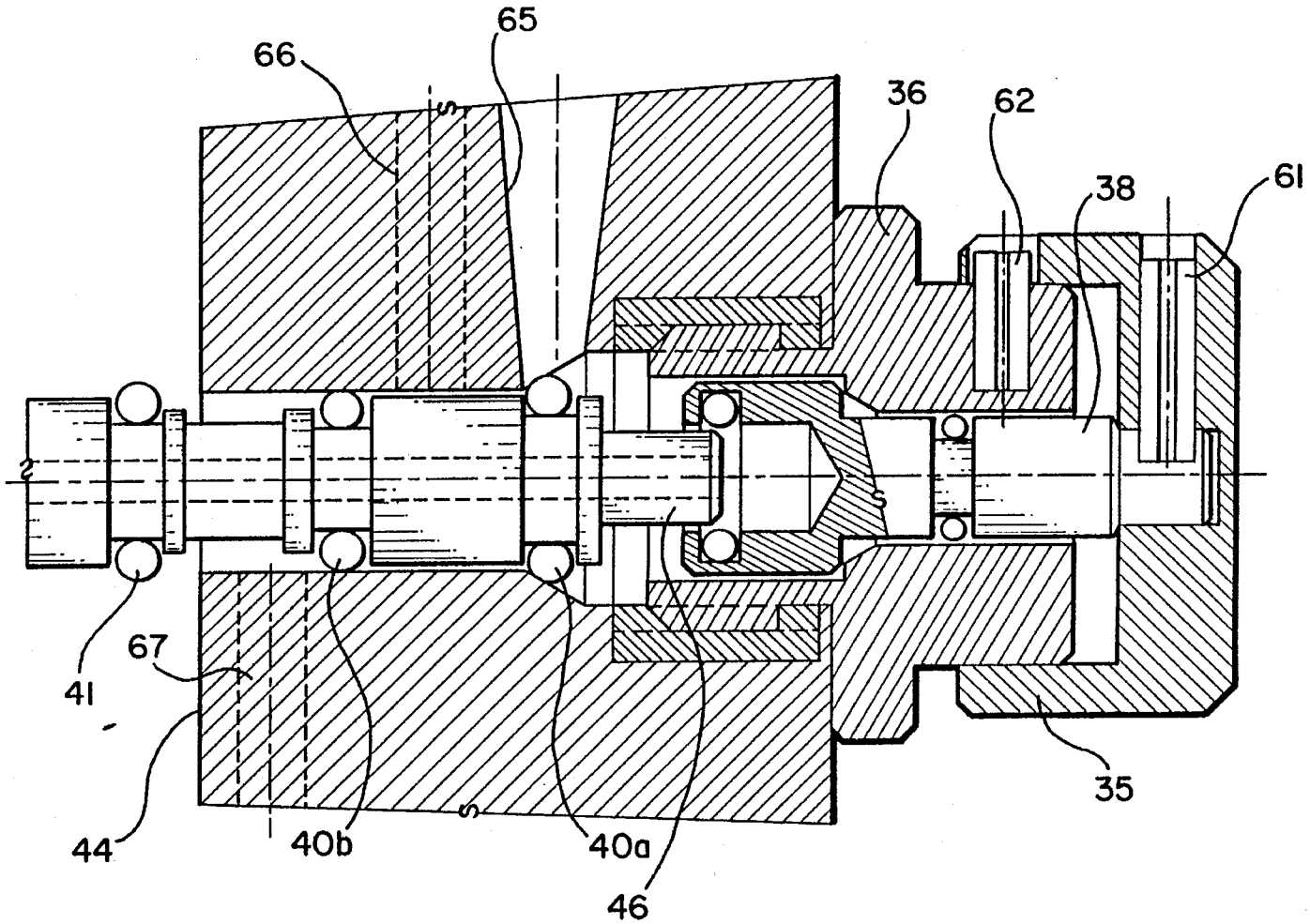
FIG. 5*a* is a cross sectional view of an air inlet and an air intake control valve in an opened position, i.e. in a suction position.

An aluminium press-in liner 39 of an air control valve is embedded in the massive partition wall of the tool lower part 44, and is provided with a valve bush 36 screwed therein. A hole for said press-in liner 39 in the massive partition wall continues upwards and forms a guiding hollow of a valve rod 46 (FIGS. 5*a* and 5*b*) which reaches into a valve body 38 of the air regulating valve.

Two connecting bolts 30 (with washers 31 and nuts 32) connecting the lower part 44 with the tool body 45 pass through the massive partition wall. After tightening said connecting bolts 30, a definitive position of the lower part 44 in relation to the tool body 45 is secured in a fitted connection place of both plastic elements, said connection place being air-tight in the air working pressure range of the riveting tool.

Figure 6:
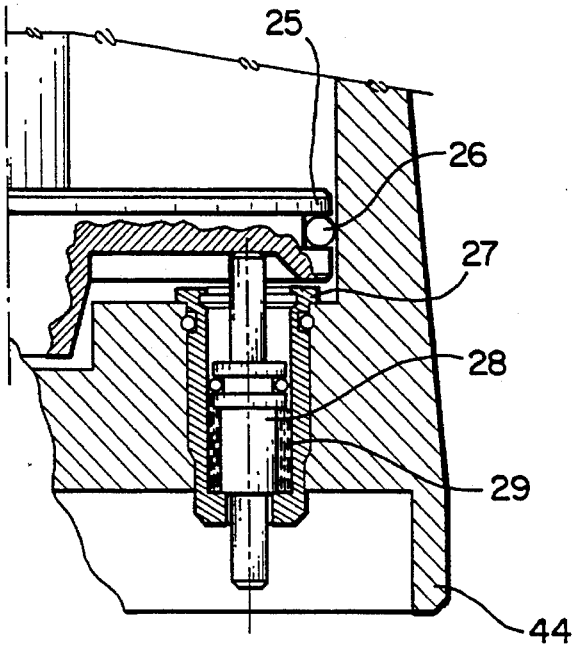
FIG. 6 is a cross sectional view of an oil gauge mounted in a massive lower partition wall of the tool, said gauge being in position of normal state, i.e. with satisfactory quantity of oil in a hydraulic system of the tool.
Figure 7:
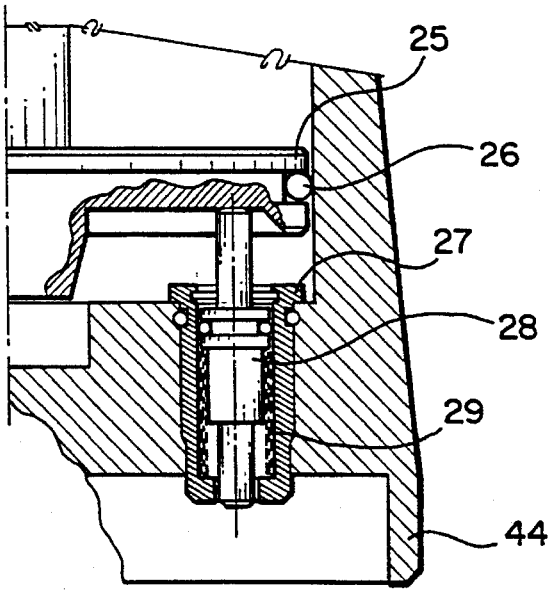
FIG. 7 is a cross sectional view of the oil gauge in a position of oil shortage.

A cylindrical body 27 of an oil gauge is anchored in the massive partition wall, wherein said oil gauge serves for indication of hydraulic oil volume above the pneumatic piston 25. A sealed small piston 28 is guided through the cylindrical body 27 and a compression spring 29 is mounted between a shoulder thereof and a bottom of the cylindrical body 27, and a safety element is mounted above said shoulder. One end of the small piston 28 bears on a lower surface of the pneumatic piston 25 and second indicating end of the same passes through a hole in the bottom of the cylindrical body 27. Said cylindrical body 27 is anchored by double-shoulder system in the massive partition wall and a sealing O-ring is disposed between said two shoulders on contact walls. In normal conditions and during satisfactory hydraulic oil quantity, end of the small piston 28 is shifted downwards (FIG. 6), whereas during oil insufficiency, said piston end is shifted in and is pressed unremittingly by the compression spring 29 into contact with the pneumatic piston 25. The piston 25 is protected against shifting out, as mentioned above, by a safety spring. A sealing O-ring preventing air leakage from a working space under the piston 25 is mounted on the small piston 28.

Blind holes for exchangeable adapters 1 for rivets may be formed in the massive partition wall of the tool lower part 44.

A transversal guide 54 for sliding support of a trigger 49 (terminating in a recess 55) is formed in an upper part of the casted tool body 45. A piston body 48 of the trigger 49 sealed in said transversal guide 54 by a sealing O-ring 53 passes through the transversal guide 54. The piston body 48 is mounted slidable through the sealing ring 47 on the hollow valve rod 46 which passes through a vertical cavity of the tool body 45. A convex leaf spring 52 bears against an upper end of the piston body 48 with a step and an upper arm thereof is supported on an transversal guide upper wall 60 of the trigger 49 and a lower arm thereof leans simultaneously against a radial surface of a piston body step 58, and said trigger 49 is contiguous with said radial surface by its inner surface 59. A safety pin 51, which is positioned in the trigger transversal guide 54 in a space between the convex leaf spring 52 and the piston body 48, is fastened to the tool body 45. Said safety pin 51 prevents the convex leaf spring 52 from falling-out or shifting-out from working position and thus secures regular function of the trigger 49. The convex leaf spring 52 is formed by U-shaped steel band and arms of the same are provided with opened cut-outs through which passes the piston body 48. Arms 56 of the the convex leaf spring 52 may be in contact with a bottom of the trigger transversal guide 54 (see FIG. 1). A take up groove 57 is formed in the trigger body and a take up pin 50 passes through said take up groove 57. Both said elements take up path stroke of the trigger 49 and consequently the length of the hollow valve rod 46 shifting movement. A lower end of the valve rod 46, having outer diameter smaller than that of a guiding cavity formed in the massive partition wall of the tool lower part 44, reaches freely by its axial shoulder into an inner cavity of the valve body 38 which is slidably mounted with a sealing element 37 in a sleeve 36 (said sleeve 36 is screwed in the corresponding metallic press-in liner in the massive partition wall of the lower part 44 and is provided with a stepped hole serving as a guiding path for the valve body 38) in the massive partition wall of the lower part 44 (see FIGS. 5*a* and 5*b*). A group of radial steps and sealing members disposed therein is arranged on an outer surface of said lower end of the valve rod 46, said group defines functional passage of pressure air. The valve rod 46 is provided in the whole length thereof with a through-bore which is opened at its lower end into the inner cavity of the valve body 38 being connected with a pressure air source, and which is opened at its upper end to the rivet suction system. Three channels 65, 66, 67, disposed one above the other and arranged for pressure air supply, are opened into a guiding cavity of the valve rod 46 in the massive partition wall of the tool lower part 44. Three sealing O-rings 40*a*, 40*b*, 41 of the control valve are situated on the valve rod 46 in the radial shoulders having different diameters. A slot for pressure air supply depending on valve rod position in relation to the valve body 38 is formed among said sealing rings 40*a*, 40*b* 41 on the circumference of the valve rod 46. In a closed position of the control valve the valve rod 46 bears on by lower shoulder thereof onto a face seat surface of the valve body 38 below a throat of a supply channel 65 (leading from the angled supply valve 33) . The upper sealing O-ring 41 and the central sealing O-ring 40*b* close simultaneously an annular space between the hollow valve rod 46 and the guiding hollow wall in the massive partition wall both above the connecting channel 66, leading into a space below the pneumatic piston 25, and close to an upper surface of the massive partition wall.

In an opened position of the control valve the third lower sealing O-ring 40*a* closes said annular space between the supply channel 65 and the connecting channel 66 and the central sealing O-ring 40*b* closes a space between the connecting channel 66 and the outlet channel 67. Opened upper part of the guiding bore is connected, in said opened position of the control valve, with a space below said pneumatic piston 25 and the lower part of the guiding hollow (bore) is connected with the inner cavity of the valve body 38. Said inner cavity is formed with a blind hole in the axis of the valve body 38 on an end thereof being adjacent to the valve rod 46. The valve body 38 is provided with a sealing element (O-ring) in a radial groove formed in its inner hollow.

A regulating roller 35 is fastened by means of a resilient pin 61 on the valve body 38 mounted in the inner cavity of the sleeve 36 which is fastened to the lower surface of the massive partition wall. In the wall of the regulating roller 35, overhanging the part of the sleeve 36, is formed an L shaped groove which is intended for guiding the free end of the elastic take up pin 62, wherein said take up pin 62 is fastened in the sleeve 36. The take up pin 62 secures the exact shift out position and angular displacement of the regulating roller 35. An outer lower surface of the regulating roller 35 fits with a lower edge of the lower tool part 44 in a shifted in position thereof. Said lower edge is formed by a lower peripheral surface of the plastic ring which is slipped rigidly on the lower part 44 of the riveting tool. After putting said tool on a plane surface, the regulating roller 35 is shifted in and is guided in a vertical part of the L-shaped groove.

Each through-bore in the pneumatic piston body is sealed by O-ring against pressure air leakage (e.g. said valve rod 46 is sealed by pertinent sealing O-ring 43 in the mentioned passage, wherein a plastic ring 42 is slipped below said sealing ring 43).

The pneumatic piston 25 reaches by a narrower part thereof into a cylindrical guide in the metallic press-in liner 22. In order to increase the pneumatic piston working pressure, said cylindrical guide is provided on its narrowing cross-section with a number of steps and is opened into a working space of the hydraulic piston 9 in the upper part of the tool.

A tube 8 is pressed in an axial through-hole of the hydraulic piston 9 disposed in the axis thereof, said tube 8 serves as a guiding element for a spring 17 seating on a shoulder in a rear screw joint 21 which is screwed in the press-in liner 16 of the hydraulic piston 9. From the opposite side to the rear screw joint is fastened a catching box 20 for teared off rivet shanks after riveting operation. Said catching box 20 is provided with small holes for air passing and is secured by elastic pawl to the rear screw joint 21 in such a way that catching of rivet shanks would be safe (the pawl opens a central hole for rivet shanks passing by means of the spring and simultaneously secures the catching box 20 against falling out). The tube 8 and the catching box 20 are sealed by sealing O-rings 18, 19 to the rear screw joint 21.

Figure 8:
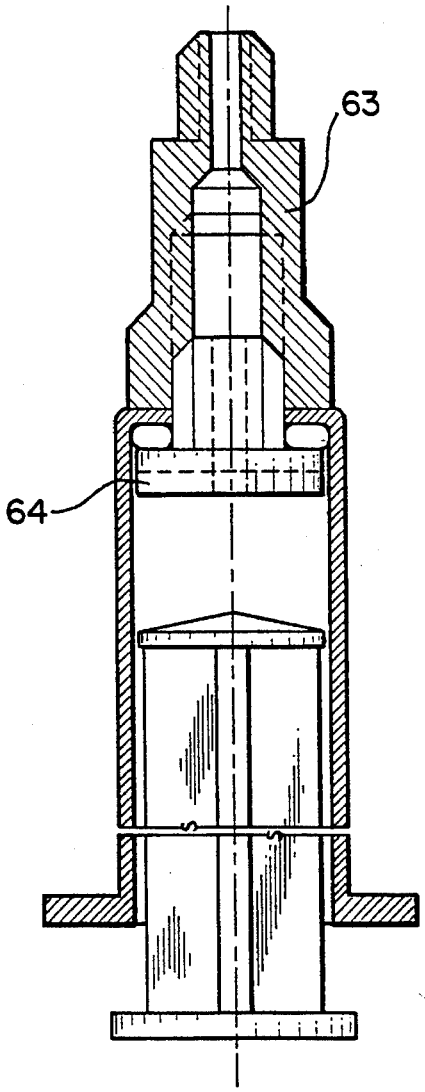
FIG. 8 is a sectional view of a filling aid for oil filling into the hydraulic system of the tool.

The hydraulic piston 9 is provided with a number of sealing elements (the sealing O-rings 7, 10, 14 and the plastic rings 11, 15) which prevent from oil leakage on all working diameters of the piston cylindrical surface. A filling hole for oil refilling is formed in the press-in liner 16 of the hydraulic piston 9. Said hole is secured, in the operating mode of the tool, by a strength screw 12 with its sealing element 13 (sealing O-ring). During oil refilling said screw 12 is removed and a filling jig (see FIG. 8) is screwed in the hole, wherein said filling jig is formed by a syringe having an oil tip 63. Said oil tip 63 is screwed on a respective screw 64 which passes through a syringe body and is sealed therein.

A compression spring 6 of a chuck collet 3 seats on the tube 8 on an opposite end of the hydraulic piston 9 with respect to the catching box 20 and an expanding mandrel 5 is mounted in said compression spring 6 from its opposite side. Face surface of the expanding mandrel 5 is shaped in accordance with bevel of the adjacent chuck collets 3 which are inserted freely into a chuck collet sleeve 4 screwed onto the hydraulic piston 9. Said rivet shank clamping unit is disposed in a front die 2 which is screwed into the press-in liner 16 of the hydraulic piston 9. The exchangeable adapter 1, being adapted to different shank diameters, serves for rivet shanks guiding and is screwed in the face wall of the front die 2.

Auxiliary suction of pressure air is directed into a space ahead of the hydraulic piston 9 through the inner hole of the valve rod 46 and the piston body 48. Said auxiliary suction serves for holding-down the rivet to the tool and thus enables riveting in any working position. Pressure air passes through the angled supply valve 33 into the supply channel 65 in the massive partition wall of the tool lower part 44 (see FIG.

Figure 9:
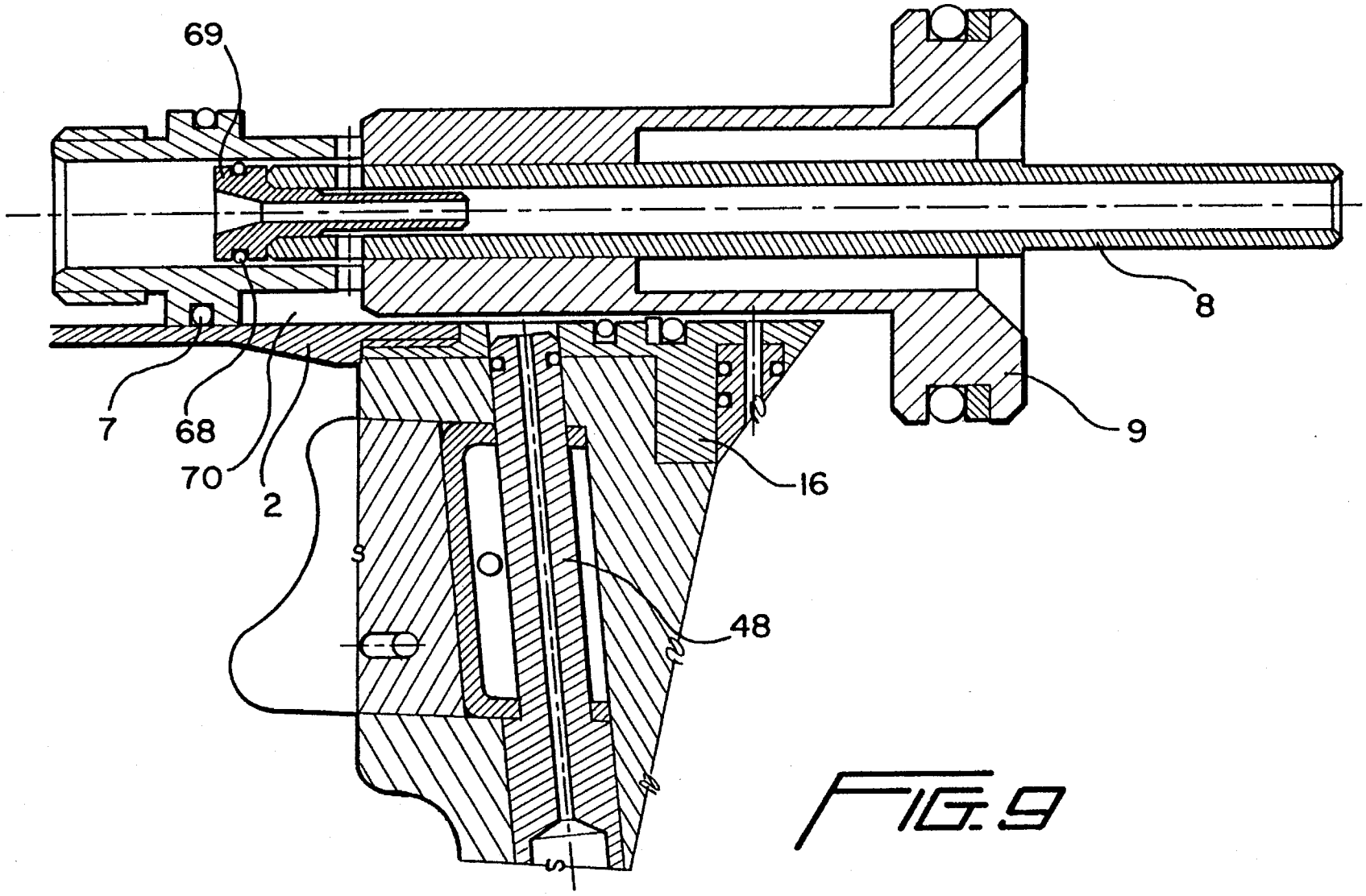
FIG. 9 is a sectional view of a system for rivet clinging in the upper part of the riveting tool.

5*a*). The lower sealing O-ring 40 of the control valve closes air passage below the pneumatic piston 25 and air streams into the space below the valve rod 46 (into the blind hole in the valve body 38) and through valve rod cavity upwards below the hydraulic piston 9 (see FIG. 9) the guiding surface of which is partially slightly stepped. That arrangement forms a gap for air passage between the hydraulic piston 9 and the press-in liner 16 of the hydraulic piston 9, wherein said press in liner 16 is screwed on the tool front die 2. Air streams into a space 70, disposed between said slight stepped part and a stepped part, comprising a groove for the sealing O-ring 7 which prevents air from entering into other part of a riveting tool. The hydraulic piston 9 and the tube 8 of the hydraulic piston 9 are moved simultaneously in a direction perpendicular to the axis of the hydraulic piston 9 in such a way that air may stream through drilled holes into a cavity of the tube 8. An inner bored small piston 69 is pressed in the front part of the tube 8 and is multiply stepped and provided with a necking-down for a sealing O-ring 68 thereof. A bore of the small piston 69 terminates by an extended conical bevel into this piston face, wherein said conical bevel serves for improved air suction into the small piston bore. Air streams subsequently through the tube 8 and the rear screw joint 21 into the catching box 20 for collecting teared off rivet shanks and exits through bores drilled on a periphery thereof. A rivet inserted in the adapter 1 is thus held by the suction of air stream to the tool and the tool may operate in arbitrary position without any risk that the rivet falls out.

Figure 5B:
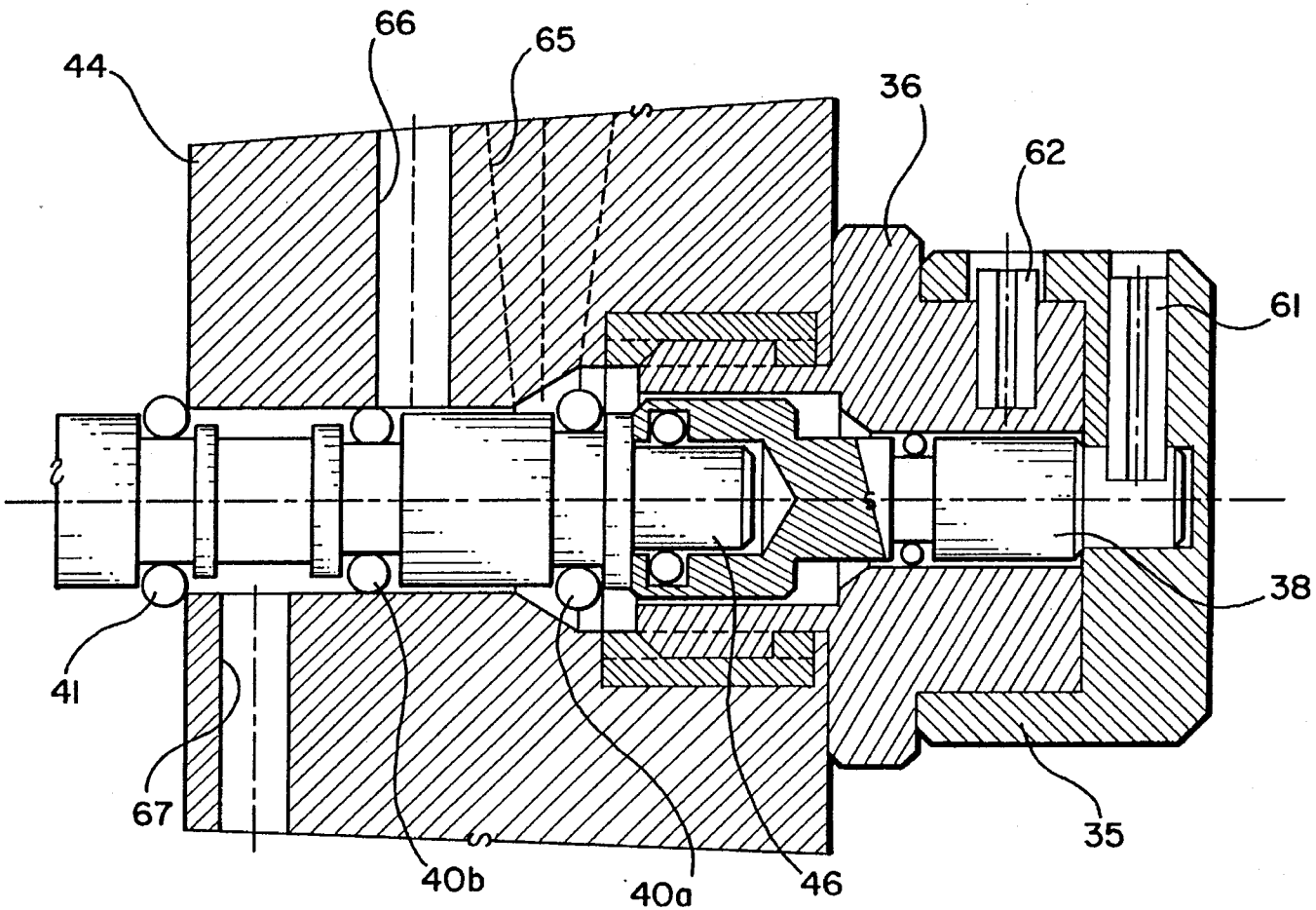
FIG. 5*b* is a cross sectional view of said control valve in a closed position, when pressure air is supplied to a space below a pneumatic piston of the tool.

After compression the trigger 49 acts to the leaf spring 52 which by action of said compression power straightens and causes movement of the piston body 48 with the valve rod 46 downwards into space of the control valve (see FIG. 5*b*). In this state, passage of air takes place through the supply channel 65 (the valve body 38 seats on the step of the valve rod 46 and prevents air from passing under the valve rod 46) and through a annular slot between the valve rod 46 and a guiding cavity wall in the massive partition wall of the tool lower part 44 into the connecting channel 66 which is opened into a space below the pneumatic piston 25. Other sealing O-rings 40, 41 on the valve rod 46, which are situated above the connecting channel 66, prevent air from passing into the outlet channel 67 that serves for safe transferring of the pressure air from the tool (in case of an air pressure that exceeds the maximum allowable pressure of the sealing O-rings 40, 41 on the valve rod 46). The pressure air arrives into a space below the pneumatic piston 25 which is then shifted upwards and the upper part thereof compresses (by means of a pressure multiplicator which is formed by step system formed by a number of narrowing diameters in the press-in liner 22) the hydraulic oil into the operating space of the hydraulic cylinder 9. The sealing O-rings 10 and the plastic ring 11 of the hydraulic cylinder 9 prevent oil from leaking into the air suction space. The slide movement of the hydraulic cylinder 9 causes compression of the spring 17 and subsequent clamping the rivet shanks by the chuck collet 3. Further action of the hydraulic piston pressure causes rivet deformation, tightening and following fracture of the blind rivet shank, which shoots towards the catching box 20.

After releasing the trigger 49 pressure air supply through the valve rod 46 under the pneumatic piston 25 is shut off. Hydraulic pressure action onto the hydraulic piston 25 ceases and the spring 17 returns the same into initial position. Said pneumatic piston 25 is returned simultaneously into its initial position.

The riveting tool can be used for connecting various parts or elements by riveting, especially by blind rivets.

I claim:

1. A riveting tool comprising:

a rivet suction system for holding a rivet in the riveting tool;

a rivet shank clamping assembly;

means for receiving pressurized air from a source of pressurized air;

a control valve having a closed position, a first position and a second position, wherein when said control valve is in said first position, pressurized air from the means for receiving pressurized air is allowed to pass to the rivet suction system, and when said control valve is in said second position, pressurized air from the means for receiving pressurized air is allowed to pass to the rivet shank clamping assembly;

a trigger for moving the control valve from the first position to the second position; and pressure responsive regulating means for moving the control valve from the closed position to the first position by lifting the tool from a substantially planer surface.

2. A riveting tool with a rivet suction system comprising:

a tool body;

a hydraulic controlled rivet shank clamping assembly within said tool body including a chuck collet and a hydraulic cylinder;

means for receiving pressurized air from a source of pressurized air;

a pneumatic piston;

a control valve including a valve rod;

a space above the pneumatic piston connected to said hydraulic cylinder and a space below said pneumatic piston connected to said control valve;

said valve rod having a valve rod piston on an upper end thereof;

a trigger;

said trigger being mounted slidably in a trigger transverse guide in the tool body;

a spring having an upper arm which is supported by a wall of the trigger transverse guide and a lower arm which contacts a shoulder of said valve rod piston, whereby pressure applied to the trigger causes the valve rod to move within the control valve from a first position to a second position;

a plurality of radial steps arranged on an outer surface of a lower end of said valve rod;

a plurality of sealing elements on said lower end of said valve rod defining passages for pressurized air; and said valve rod has a through hole through an entire length thereof, which hole opens on the lower end of the valve rod into an inner cavity of said control valve and on an upper end of the valve rod into said rivet suction system;

whereby when said valve rod is in the first position, pressurized air is guided from the means for receiving pressurized air to the rivet suction system, and when said valve rod is in the second position, pressurized air is guided from the means for receiving pressurized air to the space below the pneumatic piston.

3. A riveting tool as claimed in claim 2, further comprising:

three channels for pressurized air open into the inner cavity of the control valve, including a supply channel for supplying pressurized air, a connecting channel for connecting said control valve to the space below the pneumatic piston and an outlet channel for exhausting air;

said plurality of sealing elements includes three sealing O-rings arranged in said radial steps on the valve rod;

wherein in the second position of said valve rod the valve rod bears on a face seat surface of the valve inner cavity to prevent pressurized air from entering said valve rod through hole, and in said second position pressurized air is permitted to pass from said supply channel to said connecting channel, and in the first position of said valve rod pressurized air is allowed to pass through said valve rod through hole into said rivet suction system and from said connecting channel to said outlet channel.

4. A riveting tool as claimed in claim 3, further comprising a sealing element mounted in a radial groove formed in the inner cavity of the control valve.

5. A riveting tool as claimed in claim 2, wherein said control valve includes a valve body which is seated slidably in a sleeve arranged in a lower part of the tool.

6. A riveting tool as claimed in claim 5, further comprising a regulating roller clamped on said control valve body, wherein a wall of said regulating roller, which overhangs a section of said sleeve, is provided with an L-shaped groove for guiding a free end of a take up pin, said pin being fastened in the sleeve, and wherein placing said tool on a planar surface causes the regulating roller to shift into the tool body closing the control valve.

7. A riveting tool as claimed in claim 2, further comprising an oil gauge positioned in a lower wall of said pneumatic piston, said oil gauge comprising a cylindrical body, a sealed piston at one end thereof which bears on a lower surface of said pneumatic piston and a compression spring for returning said piston to an extended position.

8. A riveting tool as claimed in claim 7, wherein the oil gauge cylindrical body is anchored in the lower wall of said pneumatic piston by a double step system and a sealing element is disposed between the two steps.

9. A riveting tool as claimed in claim 2, further comprising a safety pin disposed in said transverse guide of said trigger in a space between the spring and the valve rod piston and fastened at both ends to the tool body and wherein said spring is convex.

10. A riveting tool as claimed in claim 9, wherein said convex spring is formed of a U-shaped steel strip wherein the upper and lower arms are provided with opened recesses through which said valve rod piston passes.

11. A riveting tool as claimed in claim 10, wherein the spring arms bear on the transverse guide of the trigger.

* * * * *